US005975931A

United States Patent [19]

Ishikawa

[11] Patent Number: 5,975,931

[45] Date of Patent: Nov. 2, 1999

[54] APPARATUS FOR ESTABLISHING ELECTRICAL CONNECTION BETWEEN STATIONARY BODY AND ROTATING BODY

[75] Inventor: Satoshi Ishikawa, Shizuoka-ken, Japan

[73] Assignee: Yazaki Corporation, Tokyo, Japan

[21] Appl. No.: 08/957,384

[22] Filed: Oct. 23, 1997

Related U.S. Application Data

[63] Continuation of application No. 08/693,964, Aug. 7, 1996, abandoned.

[30] Foreign Application Priority Data

Aug. 11, 1995 [JP] Japan ..... 7-206055

[51] Int. Cl.[6] ..... H01R 35/04

[52] U.S. Cl. ..... 439/164; 439/15

[58] Field of Search ..... 439/164, 15

[56] References Cited

U.S. PATENT DOCUMENTS 5,171,153 12/1992 Kubota et al. ..... 439/164

5,588,854 12/1996 Ikumi et al ..... 439/164

FOREIGN PATENT DOCUMENTS 6-19291 3/1994 Japan .

6-26185 4/1994 Japan .

*Primary Examiner*—Gary F. Paumen

*Attorney, Agent, or Firm*—Finnegan, Henderson, Farabow, Garrett & Dunner, L.L.P.

[57] ABSTRACT

An apparatus for establishing the electrical connection between a stationary body and a rotating body having flanges formed in the lower end portions of the inner portion and the outer portion of a carrier; and an annular and stepped restriction portion, the center of which is the center of rotation of the rotating body, and which is formed in either or both of the lower portions of the inner and outer portions of a cable accommodation chamber, wherein the flanges are accommodated and engaged to the lower portion of the restriction portion.

2 Claims, 6 Drawing Sheets

APPARATUS FOR ESTABLISHING ELECTRICAL CONNECTION BETWEEN STATIONARY BODY AND ROTATING BODY

This is a continuation of application Ser. No. 08/693,964, filed Aug. 7, 1996, now abandoned.

BACKGROUND OF THE INVENTION

1. Field of the Invention

The present invention relates to an apparatus for use in, for example, a steering apparatus for an automobile and capable of establishing electrical connection between a stationary body and a rotating body by a flexible flat cable.

2. Description of the Related Art

Hitherto, apparatuses for establishing the electrical connection between a stationary body and a rotating body such that electric parts mounted on an automobile and a portion for operating the electric parts provided for a steering wheel, as disclosed in, for example, Japanese Patent Laid-Open No. 2-19291 or Japanese Patent Laid-Open No. 6-26185, include a structure arranged such that an internal cable-accommodation chamber formed into an annular shape by a rotating body and a stationary body accommodates a flexible flat cable in a state where the flexible flat cable is wound in an inverted manner such that an inside portion and an outside portion of the flexible flat cable are wound in the opposite directions with respect to an intermediate position of the cable length. Moreover, an annular carrier, a portion of which is divided by a cable guide groove, is disposed between the inside portion and the outside portion of the flexible flat cable so as to be capable of moving in the circumferential direction of the apparatus. The intermediate portion of the flexible flat cable is allowed to pass through the cable guide groove of the carrier. When the rotating body is rotated, the carrier handles the flexible flat cable so that the flexible flat cable is passed between inside portion or the outside portion. Thus, the inside and outside portions of the flexible flat cable are wound and rewound with respect to the inside and outside portions of the cable accommodation chamber while preventing unraveling. Moreover, vertical movement of the carrier and collision of the same to the upper and lower walls of the cable accommodation chamber occurring when the automobile is vibrated vertically is prevented to avoid generation of noise.

However, the apparatus for establishing the electrical connection disclosed in Japanese Patent Laid-Open No. 6-19291 has a complicated structure in that the carrier comprises upper and lower support portions and an elastic member disposed to span the inner and outer portions of the upper and lower support portions. Thus, the cost of the apparatus cannot be reduced.

Also the apparatus for establishing the electrical connection disclosed in Japanese Patent Laid-Open No. 6-26185 has a complicated structure in that an annular recess is formed in the top surface of the cable accommodation chamber and the top end portion of the carrier is rotatively received in the annular recess. Thus, cost reduction cannot be attained.

SUMMARY OF THE INVENTION

Accordingly, an object of the present invention is to provide a high-quality and satisfactorily reliable apparatus for establishing the electrical connection between a stationary body and a rotating body capable of preventing generation of noise occurring due to vertical vibrations of the carrier without use of any special structure for preventing vibrations.

According to one aspect of the present invention, there is provided an apparatus for establishing the electrical connection between a stationary body and a rotating body having a structure such that the rotating body is coaxially and rotatively coupled to the stationary body to form an annular cable accommodation chamber for spirally accommodating a flexible flat cable in such a manner that an end of the flexible flat cable is secured to the stationary body and another end of the flexible flat cable is engaged to the rotating body, an annular carrier, a portion of which is separated by a cable guide groove, is disposed between the inside portion and the outside portion of the flexible flat cable so as to be capable of moving in the circumferential direction, an intermediate portion of the flexible flat cable is allowed to pass through the cable guide groove of the carrier to divide the inside portion and the outside portion of the flexible flat cable so as to wind and rewind the flexible flat cable to and from the cable accommodation chamber, the apparatus for establishing the electrical connection between a stationary body and a rotating body comprising: flanges formed in the lower end portions of the inner portion and the outer portion of the carrier; and an annular and stepped restriction portion, the center of which is the center of rotation of the rotating body, and which is formed in either or both of the lower portions of the inner and outer portions of the cable accommodation chamber, wherein the flanges are accommodated and retained under the lower portion of the restriction portion.

According to the structure above, the flanges of the carrier can be accommodated and retained under the lower portion of the restriction portion simply by coaxially and rotatively coupling the rotating body and the stationary body to each other in such a manner that the carrier is disposed in the cable accommodation chamber. Therefore, the restriction portion restricts upward movement of the carrier. As a result, vibrations of the carrier can be prevented.

In another aspect of the invention, there is provided an apparatus for establishing the electrical connection between a stationary body and a rotating body as described above, wherein either of the stationary body or the rotating body is vertically divided with respect to the flanges of the carrier, the thickness of a peripheral wall of an upper divided member is made to be larger than that of a peripheral wall of a lower divided member, and inner stepped portions of the peripheral walls are formed into restriction portions.

According to this latter structure, the stepped portion, in terms of the thickness of the peripheral walls of the vertically-divided members, is formed into the restriction portion. As a result, appropriate spaces for accommodating the flexible flat cable in the cable accommodation chamber can be maintained.

Other objects, features and advantages of the invention will be evident from the following detailed description of the preferred embodiments described in conjunction with the attached drawings.

DETAILED DESCRIPTION OF THE PREFERRED EMBODIMENTS

Figure 1:
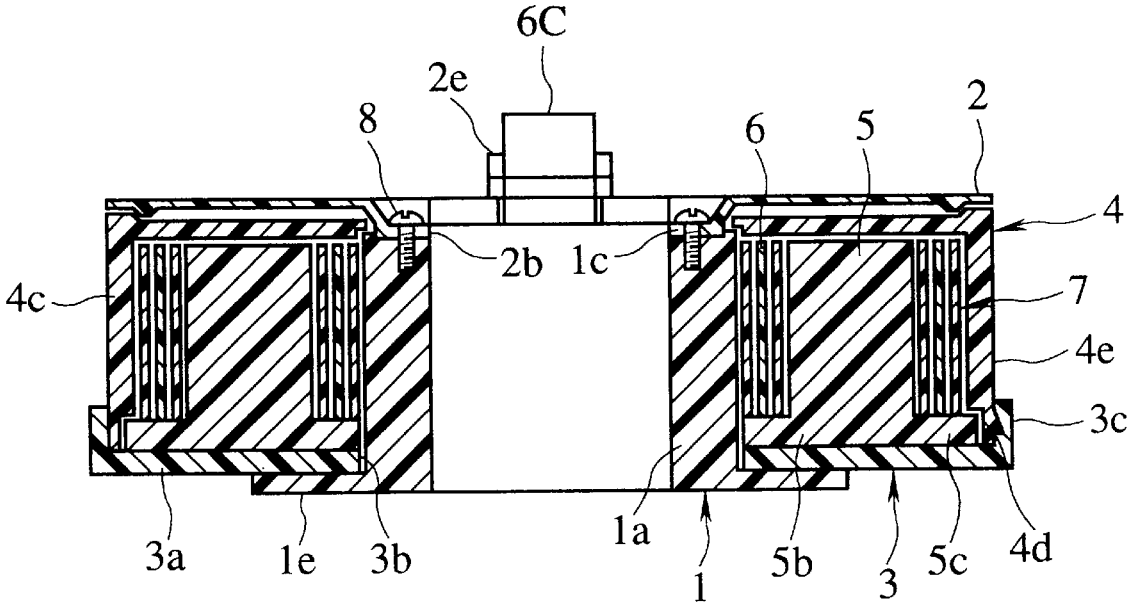
FIG. 1 is a cross sectional view of a first embodiment of the present invention.

Preferred embodiments of the present invention will now be described with reference to the drawing.

Figure 2:
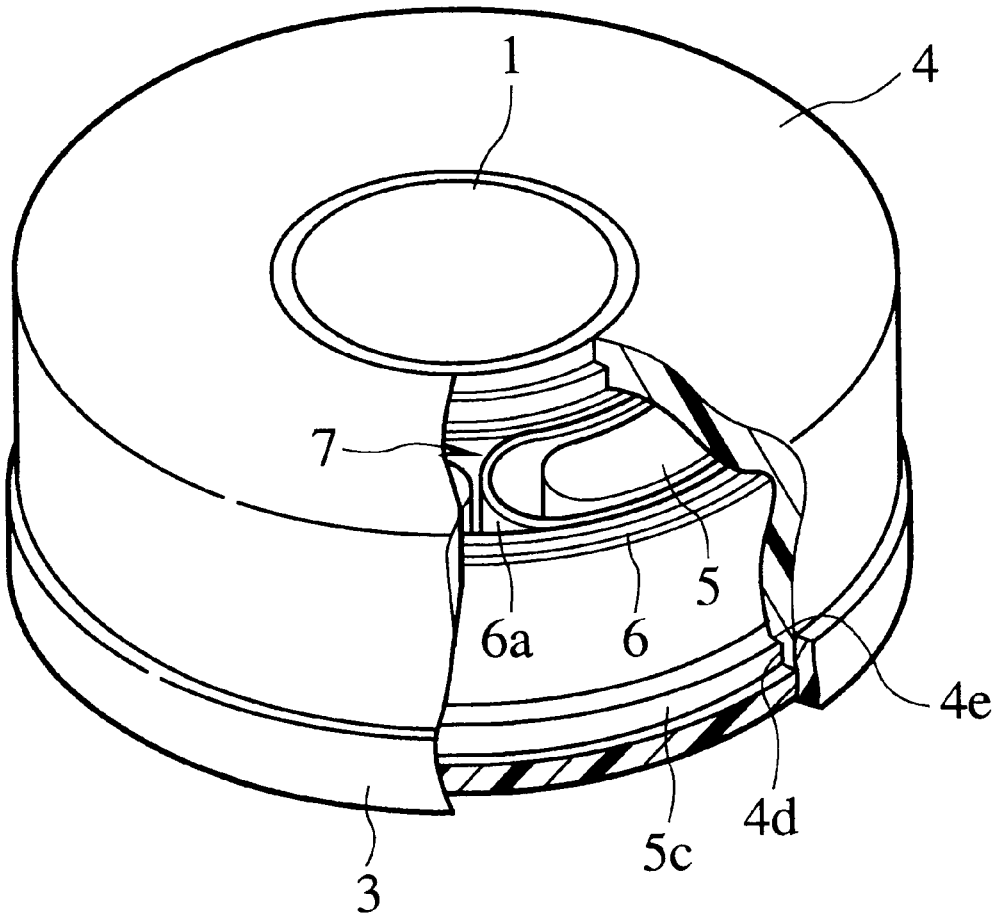
FIG. 2 is a perspective view of the first embodiment of the present invention.
Figure 3:
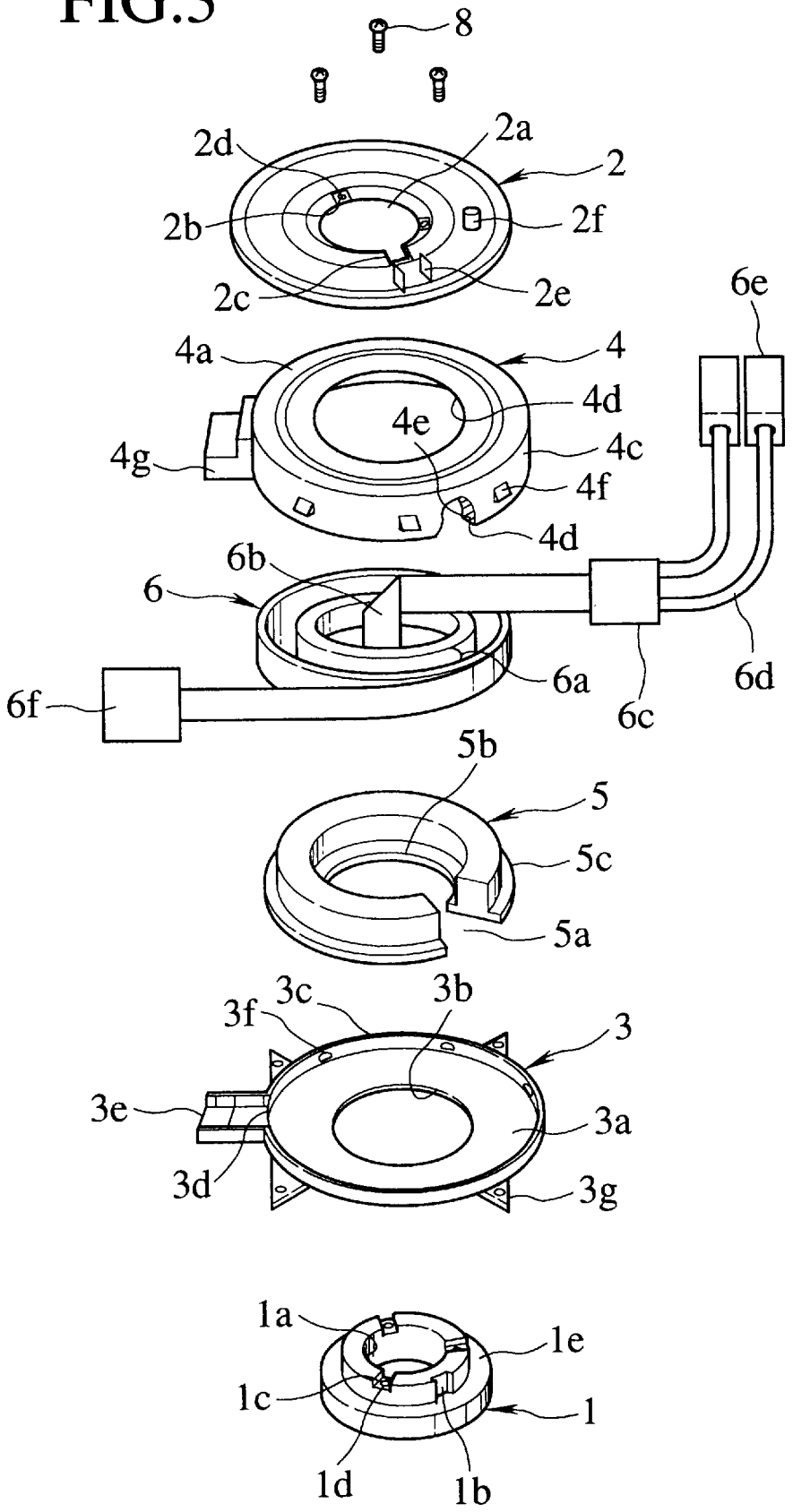
FIG. 3 is an exploded perspective view of the first embodiment of the present invention.

Referring to FIGS. 1 to 3, reference numeral 1 represents a rotor having, in a central portion thereof, a boss portion 1*a* into which, for example, a steering shaft of a steering apparatus (not shown) is rotatively inserted.

The boss portion 1*a* has, on the outer surface thereof, engaging grooves 1*b* and a plurality of horizontal grooves 1*c* formed in the top end surface thereof. The horizontal grooves 1*c* have threaded holes 1*d* in the bottom surface thereof. Moreover, an annular flange 1*e* is integrally formed in the lower portion of the boss portion 1*a* to project outwards over the outer surface of the boss portion 1*a*.

Reference numeral 2 represents an upper cover having, in the central portion thereof, an opening 2*a* having substantially the same size as that of the central hole formed in the boss portion 1*a* of the rotor 1. The upper cover 2 has internal projections 2*b* formed on the inner surface thereof, which forms the opening 2*a*, the internal projections 2*b* projecting inwards to correspond to the horizontal grooves 1*c* of the rotator 1. Moreover, a cut portion 2*c* is formed in the foregoing inner surface to correspond to the engaging grooves 1*b* of the rotor 1. The internal projections 2*b* have, in the bottom portion thereof, a plurality of through holes 2*d* which correspond to threaded holes 1*d* of the rotator 1 and receiving screws 8.

The upper cover 2 has, on the upper surface thereof, a holder portion 2*e* formed outer than the cut portion 2*c* in the radial direction and an external projection 2*f* for integrally and rotatively connecting the upper cover 2 to, for example, a steering wheel of a steering apparatus (not shown), each of the holder portion 2*e* and the external projection 2*f* being formed integrally with the upper cover 2 to project over the foregoing upper surface.

The upper cover 2 is joined to the rotor 1 by downward insertion of the internal projections 2*b* of the upper cover 2 into the horizontal grooves 1*c* of the rotator 1 and by inserting screws 8 into the threaded holes Id of the rotator 1 through the through holes 2*d* of the upper cover 2. Thus, a rotating member is formed.

Reference numeral 3 designates an under cover formed into a circular tray like shape. A bottom wall 3*a* of the under cover 3 has an opening 3*b* in the central portion thereof, the opening 3*b* having a size substantially the same as the outer diameter of the boss portion 1*a* of the rotator 1.

A peripheral wall 3*c* of the under cover 3 has a cut portion 3*d*. A holder portion 3*e* is formed integrally with the under cover 3 to horizontally project over the cut portion 3*d*.

A plurality of engaging recesses 3*f* are formed in the inner surface of the peripheral wall 3*c* of the under cover 3. The peripheral wall 3*c* has, on the outer surface thereof, a plurality of attachment portions 3*g* formed integrally with the peripheral wall 3*c* so as to be attached to, for example, a steering wheel of a steering apparatus (not shown).

Reference numeral 4 represents a cylindrical cover having an inner diameter which is substantially the same as the inner diameter of the peripheral wall 3*c* of the under cover 3. The upper wall 4*a* has, in the central portion thereof, an opening 4*b*, the size of which is smaller than the outer diameter of the boss portion 1*a* of the rotator 1.

A peripheral wall 4*c* of the cover 4 has, in the lower end portion of the inner surface thereof, an annular recess 4*d* having stepped portions so as to receive the outer end portion of a flange 5*c* formed in the outer peripheral portion of a carrier 5 to be described later, the outer end portion of the flange 5*c* being received in such a manner that the center of rotation of the rotating body is centered. The top surface of the recess 4*d* serves as a restricting portion 4*e* for restricting upward movement of the flange 5*c*.

The peripheral wall 4*c* of the cover 4 has a plurality of hook portions 4*f* at positions corresponding to the engaging recesses 3*f* of the under cover 3 and a cover portion 4*g* at a position corresponding to the holder portion 3*e* of the under cover 3, the hook portions 4*f* and the cover portion 4*g* being formed integrally with the peripheral wall 4*c* to project over the same.

The cover 4 is coupled to the under cover 3 by causing the peripheral wall 4*c* of the cover 4 to internally touch the inner surface of the peripheral wall 3*c* of the under cover 3 in a state where the cover portion 4*g* is allowed to face the holder portion 3*e* of the under cover 3 and by causing the hook portions 4*f* to be hooked by the engaging recesses 3*f* of the under cover 3. Thus, a stationary body is formed.

The carrier 5 formed into an annular shape is accommodated in an accommodation chamber 7 formed by the boss portion 1*a* of the rotator 1 and the foregoing stationary body so as to create a gap from the boss portion 1*a* of the rotator 1 for the purpose of accommodating the inner portion of a flexible flat cable 6 to be described later. Moreover, the carrier 5 creates a gap from the peripheral wall 4*c* of the cover 4 for the purpose of accommodating the outer portion of the flexible flat cable 6.

The carrier 5 has a cable guide groove 5*a* formed by partially cutting the annular portion of the carrier 5, the height of which is smaller than the height of the accommodation chamber 7.

A flange 5*b* is formed integrally with the lower portion of the inner surface of the carrier 5, the flange 5*b* having an inner diameter substantially the same as the outer diameter of the boss portion 1*a* of the rotator 1. Moreover, a flange 5*c* is formed integrally with the outer portion of the lower portion of the carrier 5, the flange 5*c* having substantially the same size as the outer diameter of the recess 4 of the cover 4. The flanges 5*b* and 5*c* have substantially the same heights.

The flexible flat cable 6 has a length which permits the flexible flat cable 6 to follow plural rotation operations of, for example, the steering wheel of the steering apparatus. The flexible flat cable 6 is accommodated in the accommodation chamber 7 (see FIG. 1) formed by coaxially and rotatively coupling the rotating body, including the rotor 1 and the upper cover 2, to the stationary body, including the under cover 3 and cover 4. The flexible flat cable 6 is accommodated in such a manner that the inside portion and the outside portion are wound spirally in the opposite directions with respect to an inversion portion 6*a* in the form of a semicircular arc formed at an intermediate position in the lengthwise direction of the flexible flat cable 6.

The flexible flat cable 6 has a bent portion 6*b* in which the flexible flat cable 6 is bent in such a manner that the inside portion of the flexible flat cable 6 is bent diagonally to upwardly change the lengthwise direction of the flexible flat cable 6 by an angular degree of about 90 degrees (FIG. 3 shows a state where the direction is changed horizontally for convenience). The flexible flat cable 6 has cables 6*d* for establishing the connection to the outside, the cables 6*d* being connected to an upward end of the bent portion 6*b* through a support block 6*c;* connectors 6*e* connected to the ends of the cable 6*d* for establishing the connection to the outside; and a connector 6*f* connected to an outer end of the flexible flat cable 6.

The structure according to this embodiment is assembled in such a manner that the boss portion 1*a* of the rotor 1 is upwardly inserted into the opening 3*b* of the under cover 3, the bottom wall 3*a* of the under cover 3 is placed on the flange 1*e* of the rotator 1 and the rotator 1 is rotatively mounted on the under cover 3, as shown in FIG. 1.

Then, the carrier 5 is accommodated between the boss portion 1*a* of the rotator 1 and the peripheral wall 3*c* of the under cover 3, and then placed on the bottom wall 3*a* of the under cover 3.

Subsequently, the bent portion 6*b* of the flexible flat cable 6 is inserted into and engaged by the engaging grooves 1*b* of the rotor 1. Then, the support block 6*c* is allowed to upwardly project over the rotor 1. The inside portion of the flexible flat cable 6 is, several times, wound around the boss portion 1*a* of the rotor 1, and then the intermediate portion of the flexible flat cable 6 is allowed to pass through the cable guide groove 5*a* of the carrier 5. The flexible flat cable 6 is subsequently bent in a direction opposite to the winding direction to form a semicircular arc so that the inversion portion 6*a* is formed. The outside portion of the flexible flat cable 6 continued from the inversion portion 6*a* is several times wound along the carrier 5 in the opposite direction. Then, the flexible flat cable 6 is drawn into the cut portion 3*d* of the under cover 3, and then the connector 6*f* is accommodated in the holder portion 3*e* of the under cover 3. Thus, the outer end of the flexible flat cable 6 is engaged to the under cover 3, followed by being directed outward.

Subsequently, the support block 6*c,* the cable 6*d* for establishing the connection to the outside and the connector 6*e* of the flexible flat cable 6, which project upward over the rotor 1, are, through the engaging grooves 1*b* of the rotor 1, drawn to a position upper than the cover 4 from the opening 4*b* of the cover 4. While accommodating the outside portion of the flexible flat cable 6 in the cover 4, the cover 4 is placed to internally touch the peripheral wall 3*c* of the under cover 3. Moreover, the cover portion 4*g* of the cover 4 is allowed to face the holder portion 3*e* of the under cover 3, and then the hook portions 4*f* of the cover 4 is hooked by the engaging recesses 3*f* of the under cover 3. Thus, the connector 6*f* accommodated in the holder portion 3*e* is covered by the cover portion 4*g* so that the cover 4 is integrally fixed to the under cover 3.

Moreover, the support block 6*c,* cable 6*d* for establishing the connection to the outside and the connector 6*e* of the flexible flat cable 6 projecting outward over the cover 4, are drawn to a position higher than the upper cover 2 through the opening 2*a* of the upper cover 2. Then, while directing, into the cut portion 2*c* of the upper cover 2, a portion of the flexible flat cable 6 placed near the top surface of the cover 4, the upper cover 2 is mounted on the cover 4. Subsequently, the internal projections 2*b* of the upper cover 2 are inserted down into the horizontal grooves 1*c* of the rotor 1. Then, the screws 8 are inserted into the threaded holes 1*d* of the rotor 1 through the through holes 2*d* of the upper cover 2 so that the upper cover 2 is coupled to the rotor 1. Moreover, the upper cover 2 covers the upper and side surfaces of the cover 4 in a non-contact manner.

Finally, the support block 6*c* of the flexible flat cable 6 drawn to the outside of the upper cover 2 is inserted and attached to the holder portion 2*e* of the upper cover 2. Thus, the following state is realized: the flexible flat cable 6 is placed on the flanges 5*b* and 5*c* of the carrier 5 shown in FIG. 1 and the flexible flat cable 6 is accommodated in the cable accommodation chamber 10 formed by the stationary body and the rotating body; the internal end of the flexible flat cable 6 is secured to the engaging grooves 1*b* of the rotor 1; the support block 6*c* is secured to the holder portion 2*e* of the upper cover 2; the connector 6*e* connected to the support block 6*c* is directed outward; the inside portion of the flexible flat cable 6 is wound along the outer surface of the rotor 1 in one direction; the inversion portion 6*a* of the flexible flat cable 6 is disposed in the cable guide groove 5*a* of the carrier 5; the outside portion of the flexible flat cable 6 is wound along the inner surface of the peripheral wall 4*c* of the cover 4 in the opposite direction to the direction in which the inside portion of the flexible flat cable 6 is wound, with respect to the inversion portion inversion portion 6*a;* and the outer end of the flexible flat cable 6 is secured into the holder portion 3*e* of the under cover 3 and the cover portion 4*g* of the cover 4 and directed outside.

In the foregoing state, when the rotation of the stationary body including the under cover 3 and the cover 4 is restricted and the rotating body including the rotor 1 and the upper cover 2 is rotated in one direction, the portion of the flexible flat cable 6 wound around the boss portion 1*a* of the rotator 1 is unwound and wound around the inner surface of the peripheral wall 4*c* of the cover 4.

When the rotating body is rotated in a direction opposite to the foregoing direction, the portion of the flexible flat cable 6 wound around the inner surface of the peripheral wall 4*c* of the cover 4 is unwound and wound around the outer surface of the boss portion 1*a* of the rotor 1.

At this time, the inversion portion 6*a* of the flexible flat cable 6, in the state where it is allowed to pass through the cable guide groove 5*a* of the carrier 5, moves in the accommodation chamber 7 in the circumferential direction of the accommodation chamber 7 at the same speed as the rotational speed of the rotating body in the direction of the rotation of the rotating body when the flexible flat cable 6 is uncoiled (rewound) or coiled (wound). Also the carrier 5 moves in the accommodation chamber 7 in the circumferential direction of the accommodation chamber 7 to follow the inversion portion 6*a* so that loosening of the flexible flat cable 6 is prevented.

In the foregoing embodiment, the carrier 5 is inserted and placed between the boss portion 1*a* of the rotator 1 attached to the under cover 3 and the peripheral wall 3*c* of the under cover 3. Then, the cover 4 is mounted on the under cover 3 to cover the same. Thus, the external portion of the flange 5*c* of the outer portion of the carrier 5 is accommodated in the recess 4*d* of the cover 4. The restricting portion 4*e,* forming the top surface of the recess 4*d* is engaged so that movement of the flange 5*c* of the outer portion of the carrier 5 and the carrier 5 is permitted, but so as to restrict the upward movement of the carrier 5. Therefore, generation of noise due to impact between the carrier 5 and the upper wall 4*a* of the cover 4 can be prevented.

Since the flexible flat cable 6 exists on the two sides of the carrier 5, the inner surface of the peripheral wall 4*c* and the outer surface of the boss portion 1*a* of the rotator 1 and an electrical insulating layer of the flexible flat cable 6 serves as a buffer, impact and contact between the side surfaces of the flanges 5*b* and 5*c* of the carrier 5 and the boss portion 1*a* of the rotator 1 and the inner surface of the recess 4*d* of the cover 4 can be prevented.

Moreover, only by inserting and placing the carrier 5 between the boss portion 1*a* of the rotor 1, attached to the under cover 3, and the peripheral wall 3*c* of the under cover 3 and by placing the cover 4 to cover the under cover 3, the restricting portion 4*e* of the cover 4 and the flange 5*c* of the outer portion of the carrier 5 can be engaged to each other. Therefore, the structure for restricting the vertical movement of the carrier 5 is significantly simplified so that the cost of the apparatus can be reduced.

Since the flange 5*b* is formed on the inner surface of the carrier 5 and the inside portion of the flexible flat cable 6 is placed on the flange 5*b*, setting of the height of the flange 5*b* to be the same as the height of the flange 5*c* on the outer surface of the same enables the difference in the height of the flexible flat cable 6 between the inner portion and the outer portion to be eliminated. Thus, the flexible flat cable 6 can smoothly be wound and rewound when the rotating body is rotated.

Figure 4:
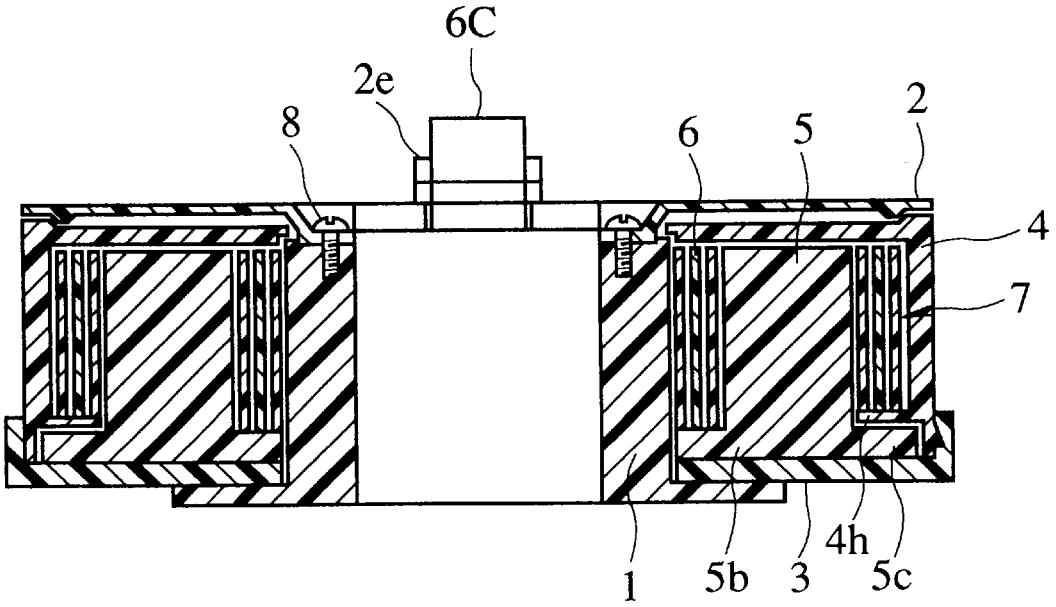
FIG. 4 is a cross sectional view of a second embodiment of the present invention.

Although the foregoing embodiment has the structure such that the recess 4*d* is formed at the lower end of the inner surface of the peripheral wall 4*c* of the cover 4 disposed to internally touch the under cover 3 to form the top surface of the recess 4*d* as the restricting portion 4*e*, a projecting restriction portion 4*h*, which is engaged to substantially the overall top surface of the flange 5*c* on the outer surface of the carrier 5, may be integrally formed with the inner surface of the lower end of the peripheral wall 4*c* of the cover 4 to place the outside portion of the flexible flat cable 6 on the restriction portion 4*h*, as shown in FIG. 4.

In the foregoing case, the thickness of the outer flange 5*c* is required to be smaller than that of the inner flange 5*b*. Moreover, the height of the top surface of the inner flange 5*b* and that of the restricting portion 4*h* are required to be the same. Thus, the difference in the height of the flexible flat cable 6 between the inside and outside portions of the same can be eliminated.

Figure 5:
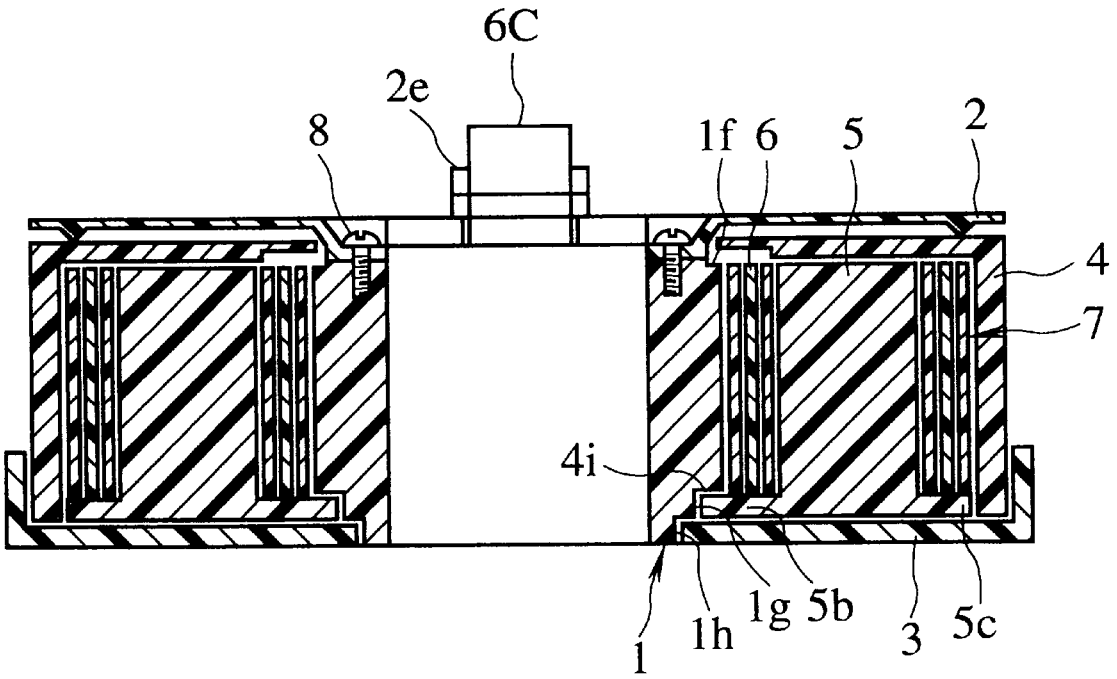
FIG. 5 is a cross sectional view of a third embodiment of the present invention.
Figure 6:
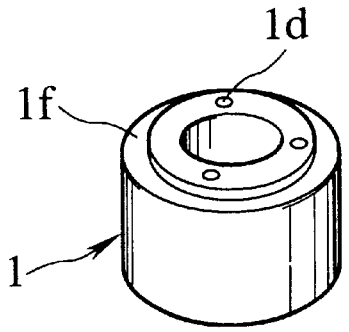
FIG. 6 is an exploded perspective view of a rotator according to the third embodiment of the present invention.

As shown in FIGS. 5 to 6, another structure may be employed in which the rotator 1 is formed into a cylindrical shape, the threaded holes 1*d* are formed on the top surface of the rotator 1, the stepped portion 1*f* for accommodating the inner portion of the cover 4 is formed in the outer portion of the top surface of the rotor 1, the stepped portion 1*g* for accommodating the inner flange 5*b* of the carrier 5 and a stepped portion 1*h* for accommodating the inner portion of the under cover 3 to be continued from the stepped portion 1*g* are formed on the outer portion of the lower end portion of the rotor 1 to form the top surface of the stepped portion 1*g* as a restriction portion 4*i*. Thus, the restriction portion 4*i* engages to the inner flange 5*b* of the carrier 5 to restrict the vertical movement of the carrier 5 so as to prevent generation of noise due to vibrations of the carrier 5.

Figure 7:
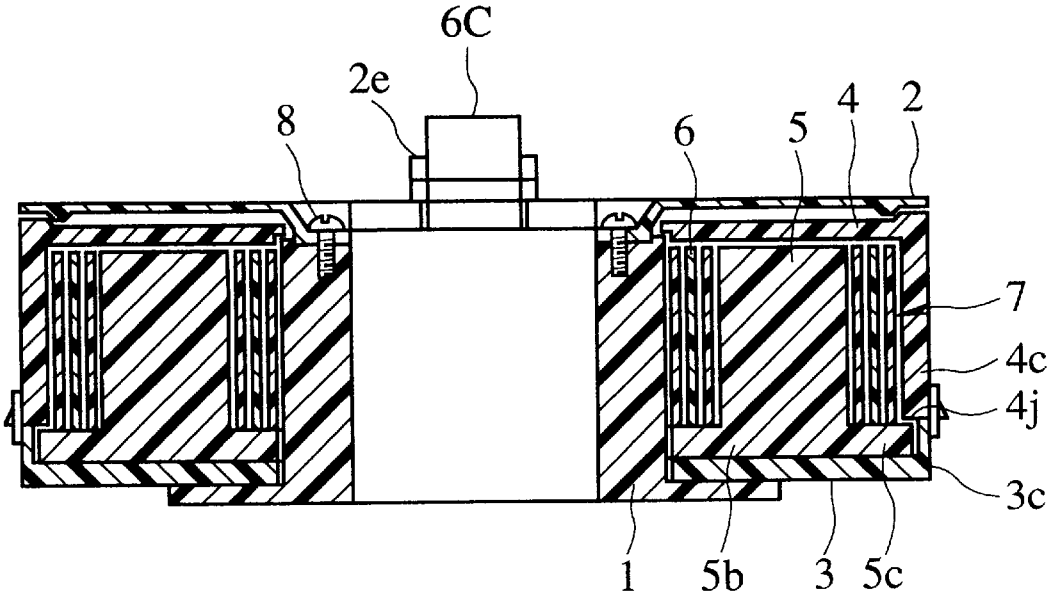
FIG. 7 is a cross sectional view of a fourth embodiment of the present invention.

As shown in FIG. 7, another structure will now be described. The outer diameter of the peripheral wall 3*c* of the under cover 3 and that of the peripheral wall 4*c* of the cover 4 are made to be substantially the same. Moreover, the thickness of the peripheral wall 3*c* of the under cover 3 is made to be smaller than that of the peripheral wall 4*c* of the cover 4. In a state where the peripheral wall 4*c* of the cover 4 vertically abuts the peripheral wall 3*c* of the under cover 3, the cover 4 and the under cover 3 are integrally secured. Moreover, the lower end surface of the peripheral wall 4*c* of the cover 4 inwards projecting over the peripheral wall 3*c* of the under cover 3 is formed into a restriction portion 4*j*. Thus, spaces for accommodating the flexible flat cable 6 can appropriately be formed between the carrier 5 and the boss portion 1*a* of the rotor 1 and between the carrier 5 and the peripheral wall 4*c* of the cover 4 without the necessity of enlarging the size of the apparatus in the radial direction.

As described above, according to the present invention, the following advantages can be obtained.

Only by coaxially and rotatively coupling the rotating body and the stationary body to each other in such a manner that the carrier is placed in the cable accommodation chamber, the flange of the carrier can be accommodated and engaged in the lower portion of the restriction portion. Thus, the upward movement of the carrier can be prevented and vibrations of the carrier can be prevented. As a result, generation of noise can be prevented and, therefore, the reliability of the quality of the apparatus can be improved.

Since the electrical insulating layer of the flexible flat cable existing between the inner surface and the outer surface of the carrier and between the inner surface and the outer surface of the cable accommodation chamber serves as a buffer, impact and contact between the side surface of the flange of the carrier and the inner and outer surfaces of the cable accommodation chamber can be prevented when the apparatus is vibrated horizontally. Thus, generation of noise due to impact and contact can be prevented.

Since the flanges are formed on the inner and outer portions of the carrier to prevent difference in the height of the flexible flat cable between the inner portion and the outer portion, the flexible flat cable can smoothly be wound and rewound when the rotating body is rotated.

Since the stepped portion of the thickness of the peripheral wall of the vertically-divided portion is formed into the restriction portion, an appropriate space for accommodating the flexible flat cable can be maintained in the cable accommodation chamber.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. An apparatus for establishing the electrical connection between a stationary body and a rotating body having a structure such that the rotating body is coaxially and rotatively coupled to the stationary body to form an annular cable accommodation chamber for accommodating a spirally wound flexible flat cable so that one end of said flexible flat cable is secured to said stationary body and another end of said flexible flat cable is engaged to said rotating body, an annular carrier having a portion separated by a cable guide groove and disposed between an inside portion and an outside portion of said flexible flat cable to be capable of moving in the circumferential direction, an intermediate portion of said flexible flat cable passing through said cable guide groove of said carrier to divide the flat cable into the inside portion and the outside portion to enable winding and rewinding of said flexible flat cable to and from said cable accommodation chamber, said apparatus for establishing the electrical connection between a stationary body and a rotating body comprising:

flanges extending from the lower end portions of an inner portion and an outer portion of said carrier; and an annular and stepped restriction portion, the center of which is the center of rotation of said rotating body, and which is formed in at least one of the lower portions of the inner and outer portions of said cable accommodation chamber, said restriction portion comprising a stepped portion formed on an outer portion of a lower end portion of said rotating body, wherein said flanges are accommodated in and restrained from vertical movement by said restriction portion.

2. The apparatus of claim 3, wherein one of said stationary body and said rotating body is vertically divided into upper and lower members with respect to said flanges of said carrier, the thickness of a peripheral wall of the upper member being larger than that of a peripheral wall of the lower member to provide the annular and stepped restriction portion.

* * * * *

UNITED STATES PATENT AND TRADEMARK OFFICE

CERTIFICATE OF CORRECTION

PATENT NO. : 5,975,931
DATED : November 2, 1999
INVENTOR(S) : Satoshi Ishikawa

It is certified that error appears in the above-identified patent and that said Letters Patent is hereby corrected as shown below:

Claim 2, column 10, line 3, "claim 3" should read --claim 1--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*